US010400486B2

(12) United States Patent
Nakasone

(10) Patent No.: US 10,400,486 B2
(45) Date of Patent: Sep. 3, 2019

(54) LOCKING DEVICE AND LOCKING DEVICE MOUNTING METHOD

(71) Applicant: PIOLAX, INC., Yokohama-shi (JP)

(72) Inventor: Hisashi Nakasone, Yokohama (JP)

(73) Assignee: PIOLAX, INC., Yokohama-Shi, Kanagawa (JP)

( * ) Notice: Subject to any disclaimer, the term of this patent is extended or adjusted under 35 U.S.C. 154(b) by 414 days.

(21) Appl. No.: 15/118,066

(22) PCT Filed: Feb. 12, 2015

(86) PCT No.: PCT/JP2015/053793

§ 371 (c)(1),
(2) Date: Aug. 10, 2016

(87) PCT Pub. No.: WO2015/122447

PCT Pub. Date: Aug. 20, 2015

(65) Prior Publication Data

US 2017/0009496 A1 Jan. 12, 2017

(30) Foreign Application Priority Data

Feb. 13, 2014 (JP) ..... 2014-025369

(51) Int. Cl.

*E05B 83/30* (2014.01)
*E05C 9/04* (2006.01)
*E05B 79/02* (2014.01)

(52) U.S. Cl.

CPC ..... *E05B 83/30* (2013.01); *E05B 79/02* (2013.01); *E05C 9/04* (2013.01); *E05C 9/043* (2013.01); *Y10T 292/0834* (2015.04)

(58) Field of Classification Search

CPC ..... E05B 83/30; Y10T 292/0834; Y10T 292/0838; Y10T 292/084; Y10T 292/0841;

(Continued)

(56) References Cited

U.S. PATENT DOCUMENTS 2,108,359 A * 2/1938 Accardi ..... E05C 9/04 292/165
5,671,958 A * 9/1997 Szapucki ..... E05C 1/10 292/175

(Continued)

FOREIGN PATENT DOCUMENTS

CN 1894124 A 1/2007
JP S 58-39348 U 3/1983

(Continued)

OTHER PUBLICATIONS

International Search Report (ISR) (PCT Form PCT/ISA/210), in PCT/JP2015/053793, dated Apr. 28, 2015.

(Continued)

*Primary Examiner* — Carlos Lugo
(74) *Attorney, Agent, or Firm* — McGinn IP Law Group, PLLC

(57) ABSTRACT

A rotor member in a locking device is rotatably supported in a base member, is connected to a locking member by projecting to the back side from an opening portion formed in a mounting seat face, and drives the locking member in accordance with the operation of an operating member. A first locating portion of the base member abuts or is near an edge portion of the opening. A second locating portion is inserted into a locating hole formed in an opening and closing member. The first locating portion projects further toward the back side than the second locating member.

1 Claim, 13 Drawing Sheets

(58) Field of Classification Search
CPC ..... Y10T 292/0844; Y10T 292/0846; Y10T 292/0848; Y10T 292/0854; Y10T 292/086
See application file for complete search history.

(56) References Cited

U.S. PATENT DOCUMENTS 5,904,389 A * 5/1999 Vaishnav ..... B60R 7/06 208/208 R
6,048,006 A * 4/2000 Antonucci ..... E05B 5/00 292/336.3
6,152,512 A * 11/2000 Brown ..... B60R 7/06 296/37.12
6,669,243 B2 * 12/2003 Katoh ..... B60R 7/06 292/34
7,048,311 B2 * 5/2006 Sawatani ..... B60R 7/06 292/32
7,455,333 B2 * 11/2008 Ookawara ..... E05B 83/30 292/34
7,591,103 B2 * 9/2009 Tremble ..... E05B 9/08 292/DIG. 47
7,695,028 B2 * 4/2010 Katou ..... B60R 7/06 292/156
8,033,582 B2 * 10/2011 Sawatani ..... E05B 83/30 292/140
8,403,374 B2 * 3/2013 Shimizu ..... E05B 83/30 292/137
8,590,351 B2 * 11/2013 Ookawara ..... E05B 83/30 292/163
2005/0115289 A1 6/2005 Talukdar et al.
2014/0150505 A1 6/2014 Shimizu
2015/0008680 A1 * 1/2015 Suzuki ..... B60R 7/06 292/32

FOREIGN PATENT DOCUMENTS

JP H0460079 * 9/1992
JP 2012-246727 A 12/2012
WO WO-2012132546 A1 * 10/2012 ..... E05B 63/14
WO WO 2013/018496 A1 2/2013

OTHER PUBLICATIONS

Chinese Office Action dated Dec. 20, 2018, in Chinese Patent Application No. 201580008386.3 with an English translation.

* cited by examiner

LOCKING DEVICE AND LOCKING DEVICE MOUNTING METHOD

TECHNICAL FIELD

The present invention relates to a locking device to be mounted on an opening and closing member, and a mounting method thereof.

BACKGROUND ART

A locking device for maintaining an opening and closing member in a closed state is mounted on the opening and closing member to open and close an opening of a glove compartment of a vehicle. A user unlocks to open the glove compartment by manipulating a manipulation member of the locking device.

For example, Patent Literature 1 discloses a side locking device mounted on a door panel to open and close an opening of a storage box. The side locking device includes a positioning pin. When mounting the side locking device, positioning is made by inserting the positioning pin into a positioning hole provided to the door panel. After positioning, the side locking device is fixed to the door panel with a screw.

CITATION LIST

Patent Document

Patent Literature 1
JP-2012-246727-A

SUMMARY OF THE INVENTION

Problem that the Invention is to Solve

In the technique described in Patent Literature 1, when mounting the locking device 10 on the door panel, the user inserts the positioning pin into the positioning hole. This work is performed by looking for the positioning hole of the door panel and aligning the positioning pin of the side locking device to the positioning hole. The work of inserting the positioning pin into the positioning hole is complicated, and could take time.

The present invention is made in view of the above problem, and an object of the present invention is to provide a locking device that can be easily mounted.

Means for Solving the Problem

To solve the above-described problem, an aspect of the present invention provides a locking device that is mounted on an opening and closing member, and maintains the opening and closing member in a locked stated with a locking member, the locking device including:

a base member fixed to a mount surface of the opening and closing member; and a driving member being rotatably supported by the base member, protruding backwardly from an opening portion of the mount surface, and being connected to the locking member to drive the locking member upon manipulation of a manipulation member, wherein the base member includes a first locating portion arranged to contact or closely face an edge portion of the opening portion, and a second locating portion arranged to be inserted into a locating hole formed in the opening and closing member, and wherein the first locating portion protrudes toward the back side more than the second locating portion.

Another aspect of the present invention provides a locking device that is mounted on an opening and closing member, and maintains the opening and closing member in a locked stated with a locking member, the locking device including:

a base member fixed to a mount surface of the opening and closing member; and a driving member being rotatably supported by the base member, protruding backwardly from an opening portion of the mount surface, and being connected to the locking member to drive the locking member upon manipulation of a manipulation member, wherein the base member includes a locating portion formed around the driving member to contact or closely face an edge portion of the opening portion.

Still another aspect of the present invention provides a method for mounting a locking device including a first locating portion and a second locating portion arranged to make positioning of the locking device with respect to an opening and closing member including a first opening portion and a second opening portion, the method including:

inserting the first locating portion into the first opening portion to restrict a relative displacement between the second locating portion and the second opening portion;

after the first locating portion has been inserted into the first opening portion, inserting the second locating portion into the second opening portion to make positioning of the locking device; and fixing the locking device to the opening and closing member.

Advantageous Effects of Invention

With the present invention, a locking device can be easily mounted.

MODE FOR CARRYING OUT THE INVENTION

Figure 1A:
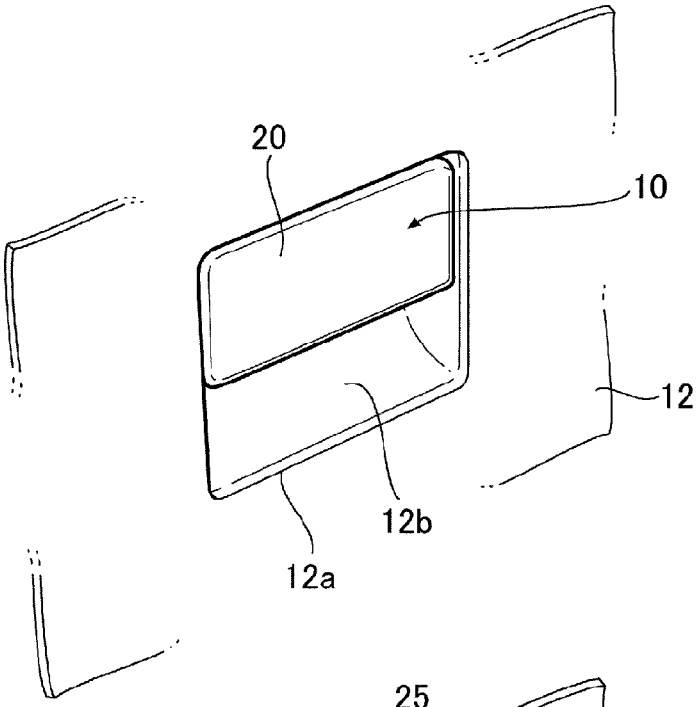
FIGS. 1A and 1B are views for illustrating an opening and closing member on which a locking device according to an embodiment of the present invention is mounted.
Figure 1B:
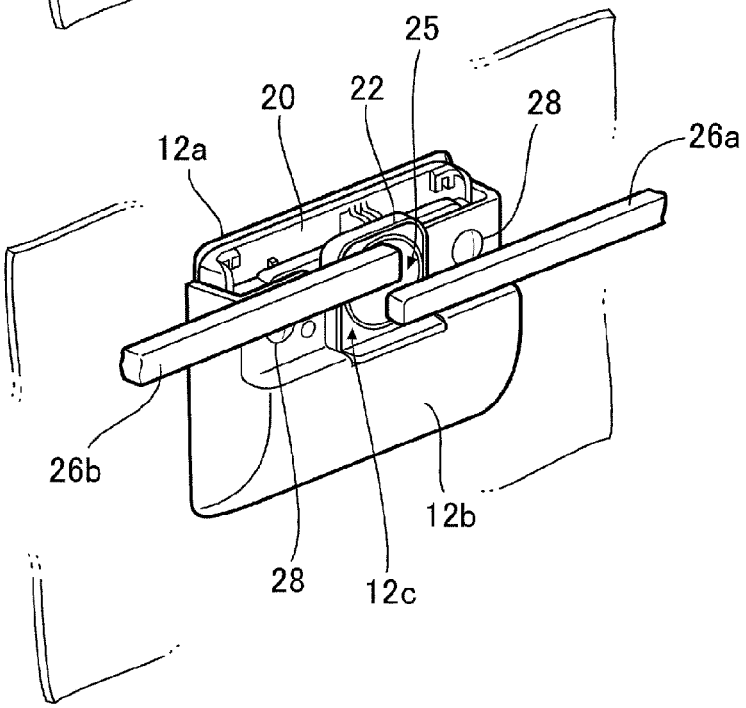
Figure 2:
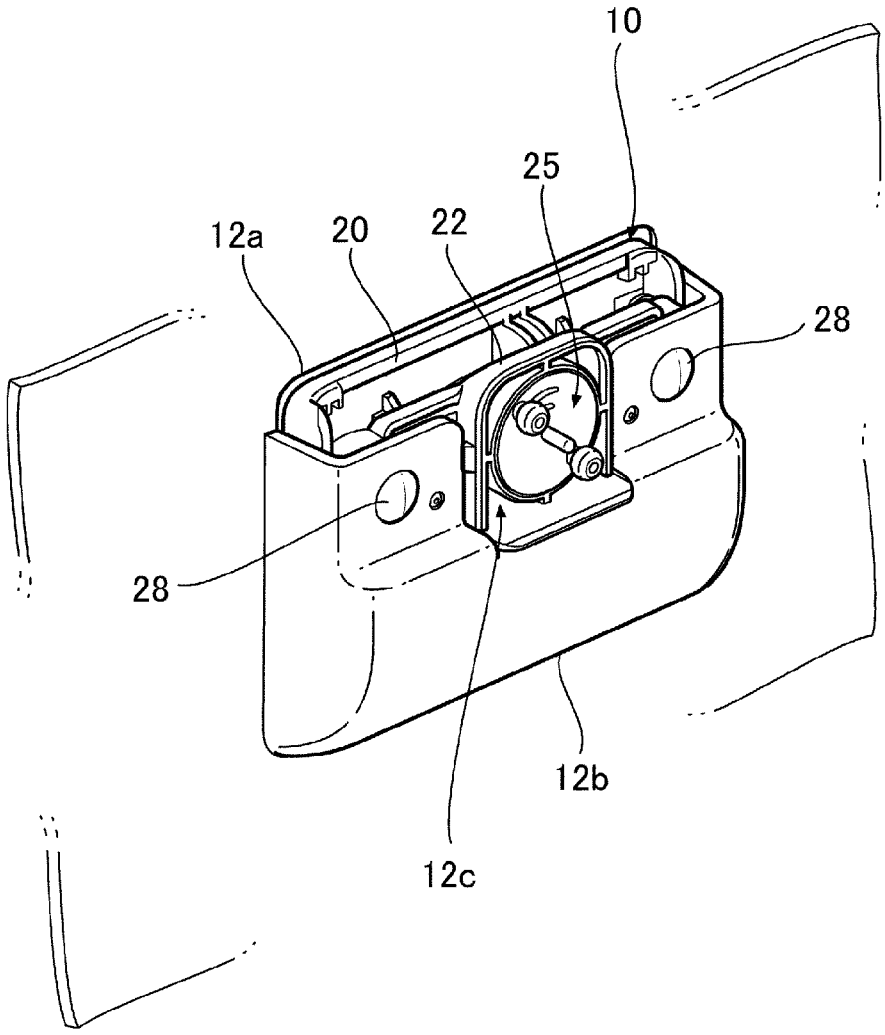
FIG. 2 is a perspective view for illustrating the locking device according to the embodiment of the present invention in the middle of being mounted on the opening and closing member.

FIGS. 1A and 1B are views for illustrating an opening and closing member 12 on which a locking device 10 according to an embodiment of the present invention is mounted. FIG. 1A is a perspective view of the opening and closing member 12 as viewed from a front side thereof, and FIG. 1B is a perspective view of the opening and closing member 12 as viewed from a back side thereof. FIG. 2 is a perspective view of the locking device 10 according to the embodiment in the middle of being mounted on the opening and closing member, where locking members are yet to be attached. While the opening and closing member 12 are actually made of two plate members bonded together and arranged to house the locking device 10 inside thereof, the plate member on the back side of the opening and closing member 12 that covers the locking device 10 is not illustrated in FIG. 1B.

The opening and closing member 12 defines, for example, a lid member for a vehicle glove compartment. The glove compartment (not illustrated) is a fixed member including a concave section that is a housing space provided in a dashboard. The opening and closing member 12 is rotatably supported by the fixed member, and arranged to open and close the opening of the concave section.

The opening and closing member 12 includes a mounting structure for mounting the locking device 10 behind a mounting port 12*a*. The locking device 10 mounted on the opening and closing member 12 maintains the opening and closing member 12 in the locked state with respect to the fixed member.

As shown in FIG. 1B, the locking device 10 includes a manipulation member 20, a base member 22, a driving member 25, a first locking member 26*a*, and a second locking member 26*b*. As shown in FIG. 1A, the manipulation member 20 is exposed to the front side from the mounting port 12*a*. A user inserts his/her fingers from a depressed portion 12*b* to the back side of the manipulation member 20, and pulls the manipulation member 20 to release the locked state.

The manipulating force by a user is transmitted from the manipulation member 20 to the driving member 25, and then from the driving member 25 to the first locking member 26*a* and the second locking member 26*b* (referred to as the"locking members 26" when they are not distinguished from each other).

As shown in FIGS. 1B and 2, the base member 22 is fixed to the opening and closing member 12 with a pair of screw members 28. The driving member 25 is rotatably supported by the base member 22, and connected to the locking members 26. The locking members 26 having a rod shape are illustrated while partially cut off in FIG. 1B. The locking members 26 are arranged to move in the width direction while interlocked with the rotational movement of the driving member 25.

User's manipulation of the manipulation member 20 rotationally moves the driving member 25, and in accordance with the rotational movement of the driving member 25, the locking members 26 get in and get out of engaging holes (not illustrated) provided to the glove compartment that defines a fixed member. When the locking members 26 get in the engaging holes of the glove compartment, the opening and closing member 12 is brought into a locked state. When the locking members 26 get out of the engaging holes, the opening and closing member 12 is brought into an unlocked state.

Figure 3A:
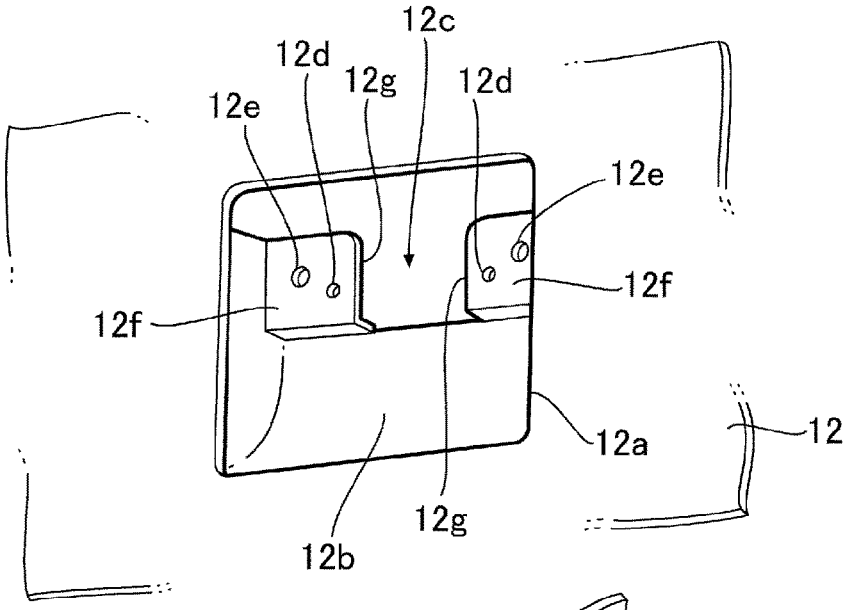
FIGS. 3A and 3B are views for illustrating the opening and closing member.
Figure 3B:
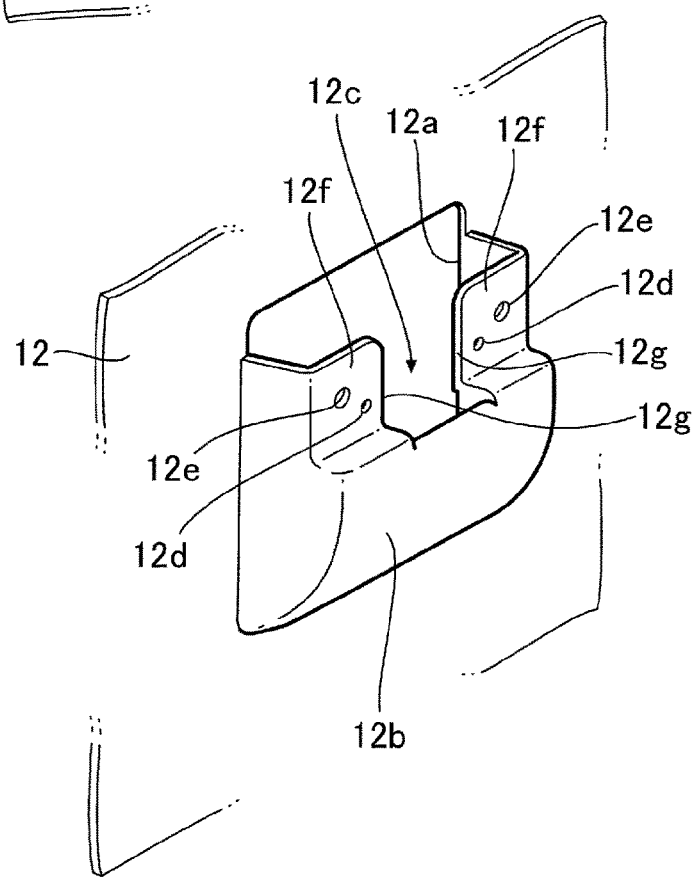

FIGS. 3A and 3B are views for illustrating the opening and closing member 12. FIG. 3A is a perspective view of the opening and closing member 12 as viewed from a front side thereof, and FIG. 3B is a perspective view of the opening and closing member 12 as viewed from a back side thereof. In the present description, same or equivalent constituent elements shown in the drawings are provided with same reference numerals, and repeated descriptions of the same or equivalent constituent elements are omitted as appropriate. FIGS. 3A and 3B illustrate the plate member on the front side of the opening and closing member 12 made of two plate members bonded together.

The opening and closing member 12 includes the mounting port 12*a*, the depressed portion 12*b*, an opening portion 12*c*, locating holes 12*d*, screw holes 12*e*, mount surfaces 12*f*, and edge portions 12*g*. As shown in FIG. 3A, a mounting structure for mounting the locking device 10 is provided behind the mounting port 12*a*.

The depressed portion 12*b* includes a curved surface extending upward from the lower end of the mounting port 12*a*, and functions as a guide where a user inserts his/her fingers. The pair of mount surfaces 12*f* that are distanced from each other in the width direction, and the opening portion 12*c* that is disposed between the mount surfaces 12*f* are disposed on the upper end of the depressed portion 12*b*.

The locking device 10 is mounted on the outer surfaces of the mount surfaces 12*f* shown in FIG. 3A. The locking device 10 is mounted on the mount surfaces 12*f* with the use of the locating holes 12*d* and the screw holes 12*e* disposed on the mount surfaces 12*f*. The pair of locating holes 12*d* and the pair of screw holes 12*e* are distanced from each other in the width direction, and the distance between the pair of locating holes 12*d* is smaller than the distance between the pair of screw holes 12*e*.

The opening portion 12*c* penetrates in order to transmit the manipulation of the manipulation member 20 on the front side to the locking members 26 disposed on the back side more than the mount surfaces 12*f*. The edge portions 12*g* of the opening portion 12*c* define the opening portion 12*c* to constitute the facing side edges of the pair of the mount surfaces 12.

As described above, the opening and closing member 12 includes a structure for mounting the locking device 10 to the opening and closing member 12. Detailed descriptions of the components of the locking device 10 will be provided further with reference to the drawings.

Figure 4A:
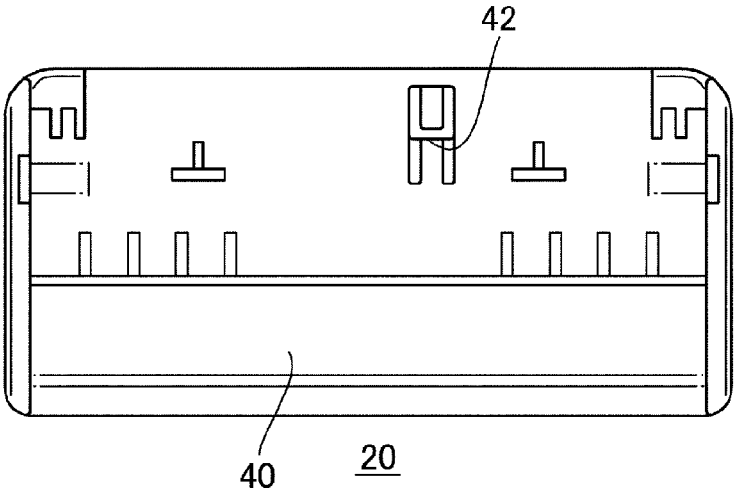
FIGS. 4A and 4B are views for illustrating a manipulation member.
Figure 4B:
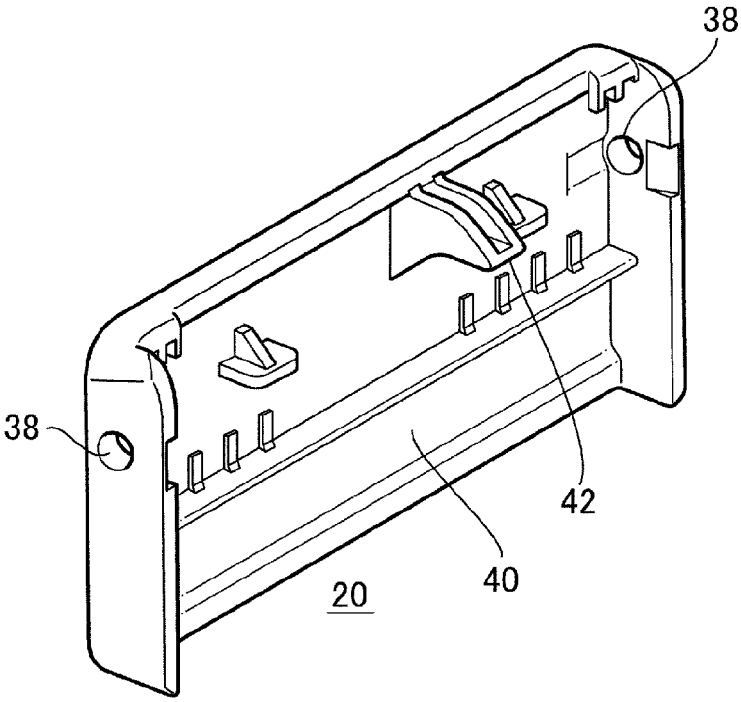

FIGS. 4A and 4B are views for illustrating the manipulation member 20. FIG. 4A is a back side view of the manipulation member 20, and FIG. 4B is a perspective view of the manipulation member 20 as viewed from a back side thereof. The front side of the manipulation member 20 is shown in FIG. 1A, and is exposed at the mounting port 12*a* of the opening and closing member 12.

The manipulation member 20 has a plate shape, and includes rotational shaft holes 38, a manipulation surface 40, and a transmission portion 42. The rotational shaft holes 38 are each disposed on the pair of side surfaces of the manipulation member 20. The manipulation surface 40 is disposed in the lower portion of the manipulation member 20 on the back surface, and a user can hook his/her fingers on the manipulation surface 40 during the manipulation.

The transmission portion 42 is erected on the back surface of the manipulation member 20, and is arranged to abut on the driving member 25 to transmit the rotational manipulation by the user to the driving member 25. By connecting the rotational shaft holes 38 to the base member 22, the manipulation member 20 is rotatably supported by the base member 22. When the manipulation member 20 rotationally moves, the transmission portion 42 moves up and down to rotationally move the driving member 25.

Figure 5A:
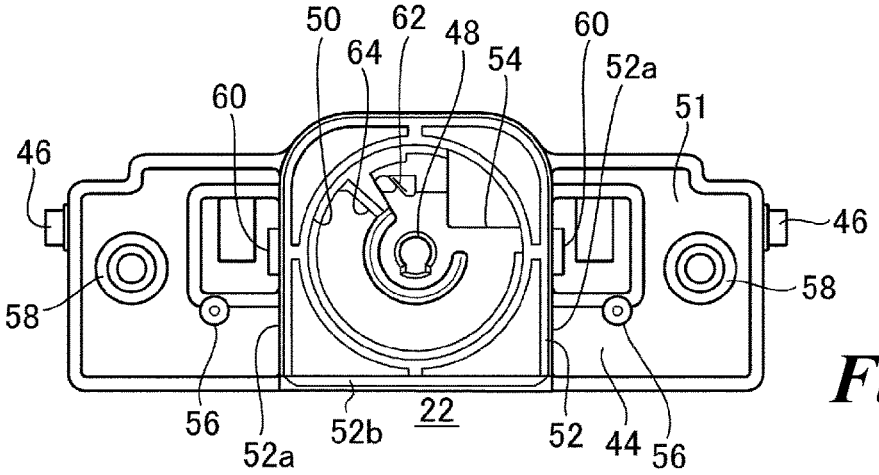
FIGS. 5A to 5C are views for illustrating a base member.
Figure 5B:
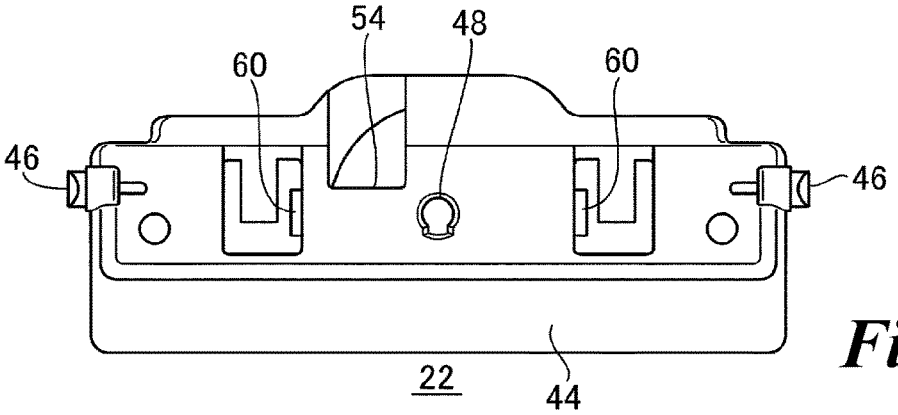
Figure 5C:
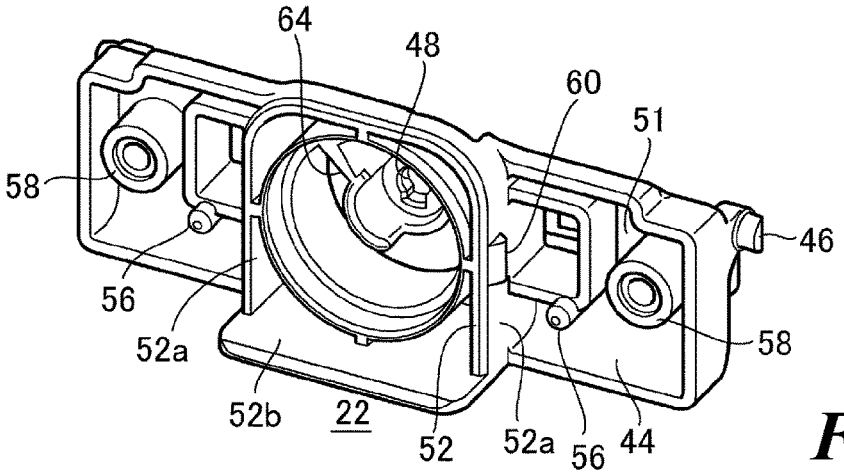

FIGS. 5A to 5C are views for illustrating the base member 22. FIG. 5A is a back side view of the base member 22, FIG. 5B is a front side view of the base member 22, and FIG. 5C is a perspective view of the base member 22 as viewed from a back side thereof.

A main body portion 44 of the base member 22 includes a pedestal surface 51 that extends in the width direction. Rotational movement supporting portions 46 protrude in the width direction from both the side surfaces of the main body portion 44. The rotational movement supporting portions 46 are inserted into the rotational shaft holes 38 of the manipulation member 20 to rotatably support the manipulation member 20. A driving bearing portion 48 is disposed in the center of the pedestal surface 51 to rotatably support the driving member 25.

A rotor supporting wall 50 is erected from the pedestal surface 51, has a circular cylindrical shape having the driving bearing portion 48 as its center, and is arranged to house the driving member 25. The rotor supporting wall 50 includes, in addition to the driving bearing portion 48, a communicating portion 54, a spring receiving portion 62, and a rotation regulating portion 64 that are disposed inside of the rotor supporting wall 50.

The communicating portion 54 penetrates the pedestal surface 51 inside the rotor supporting wall 50. The communicating portion 54 defines a communicating hole arranged to make the transmission portion 42 of the manipulation member 20 abut on a rotor member 24 of the driving member 25.

The spring receiving portion 62 has a protruding shape disposed on the pedestal surface 51 inside the rotor supporting wall 50, and abuts on a winding end portion of a spring member that constitutes the driving member 25. The rotation regulating portion 64 protrudes on the pedestal surface 51 inside the rotor supporting wall 50, and is arranged to regulate the rotation of the driving member 25.

The first locating portion 52 is disposed around the rotor supporting wall 50 so as to be erected on the pedestal surface 51 as a wall portion surrounding the rotor supporting wall 50. The first locating portion 52 is disposed in the vicinity of the outer circumference side of the rotor supporting wall 50. As shown in FIG. 5C, the first locating portion 52 protrudes the most in the base member 22.

The first locating portion 52 is inserted into the opening portion 12*c* of the opening and closing member 12, and contacts or closely faces the edge portions 12*g* of the opening portion 12*c*. The first locating portion 52 is disposed around the driving member 25 and the rotor supporting wall 50, and prevents the rotor supporting wall 50 from contacting the edge portions 12*g* of the opening portion 12*c* of the opening and closing member 12 when mounting the locking device 10 on the opening and closing member 12. In addition, the first locating portion 52 functions as a guide for facilitating the insertion of second locating portions 56 into the locating holes 12*d* when mounting the base member 22 on the opening and closing member 12.

The first locating portion 52 includes a pair of facing wall portions 52*a* that face each other in the width direction of the base member 22, and a connecting wall portion 52*b* that connects the pair of facing wall portions 52*a*. The inner wall of the first locating portion 52 is connected to the outer wall of the rotor supporting wall 50 at plural positions to improve the rigidity.

A pair of engagement pawl portions 60 protrude outward in the width direction from the facing wall portions 52*a* of the first locating portion 52. The engagement pawl portions 60 are engaged with the mount surfaces 12*f* of the opening and closing member 12 in mounting the base member 22 on the opening and closing member 12. Thus, the engagement pawl portions 60 function as temporarily fixing portions until the locking device 10 is fixed with the screw members 28.

The pair of second locating portions 56 protrude from the pedestal surface 51, and have the shape of a rod identical to each other. The second locating portions 56 define locating pins to make positioning of the base member 22 with respect to the mount surfaces 12*f* of the opening and closing member 12. The pair of second locating portions 56 are distanced from each other in the width direction, and the first locating portion 52 is disposed between the pair of second locating portions 56. By inserting the second locating portions 56 into the locating holes 12*d* of the opening and closing member 12, positioning of the sub-assembly unit 16 is made.

A pair of thread receiving portions 58 are distanced from each other in the width direction, and have holes having a circular cylindrical shape into which the screw members 28 can be screwed. The pair of second locating portions 56 are disposed between the pair of thread receiving portions 58.

Figure 6A:
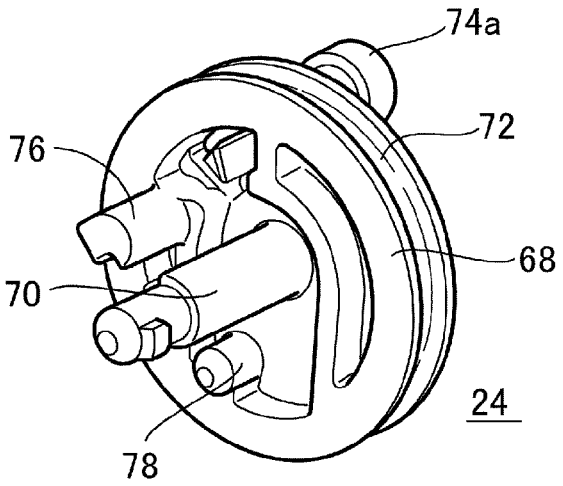
FIGS. 6A to 6C are views for illustrating a rotor member.
Figure 6B:
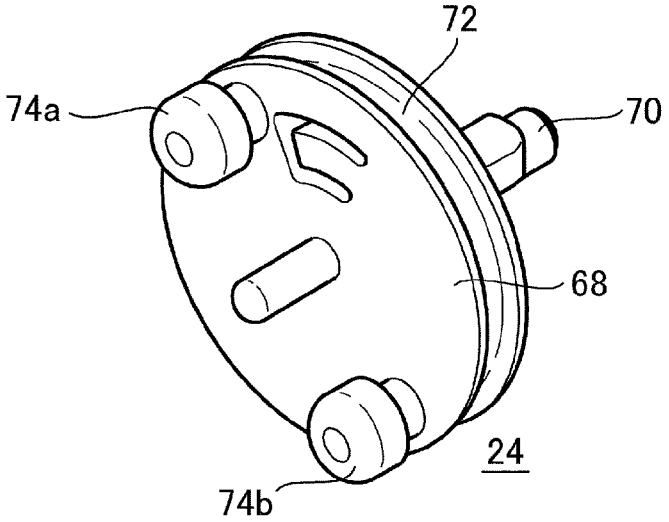
Figure 6C:
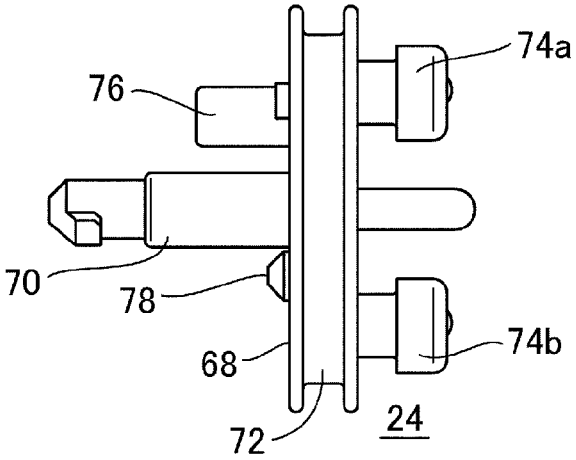

FIGS. 6A to 6C are views for illustrating the rotor member 24. FIG. 6A is a perspective view of the rotor member 24 as viewed from a front side thereof, FIG. 6B is a perspective view of the rotor member 24 as viewed from a back side thereof, and FIG. 6C is a side view of the rotor member 24.

The rotor member 24 includes a disk portion 68, a rotating shaft portion 70, a retaining groove portion 72, a first connecting portion 74*a*, a second connecting portion 74*b*, an abutting portion 76, and a spring receiving portion 78. The rotor member 24 is included in the driving member driven in accordance with the rotational manipulation of the manipulation member 20.

The rotating shaft portion 70 is erected vertically in the center of the disk portion 68. The rotating shaft portion 70 is inserted into the driving bearing portion 48 of the base member 22 so as to be rotatably supported. The retaining groove portion 72 has a groove shape disposed on the outer circumference of the disk portion 68, and is arranged to retain a ring member.

The first connecting portion 74*a* and the second connecting portion 74*b* (referred to as the "connecting portions 74" when they are not distinguished from each other) are connected respectively to the first locking member 26*a* and the second locking member 26*b*, and arranged to transmit the rotation movement of the rotor member 24 thereto. The connecting portions 74 protrude vertically on the back surface of the disk portion 68. In addition, the connecting portions 74 are distanced from the center of the disk portion 68 on the back surface, and disposed on the outer side in the radial direction on the disk portion 68 so as to face each other.

The abutting portion 76 protrudes on the front surface of the disk portion 68. The abutting portion 76 is mounted on the base member 22 so as to be capable of abutting on the transmission portion 42 via the communicating portion 54, and the manipulating force of the manipulation member 20 is transmitted from the transmission portion 42. The spring receiving portion 78 protrudes on the front surface of the disk portion 68, and is arranged to abut on a winding end portion of a spring member.

Figure 7:
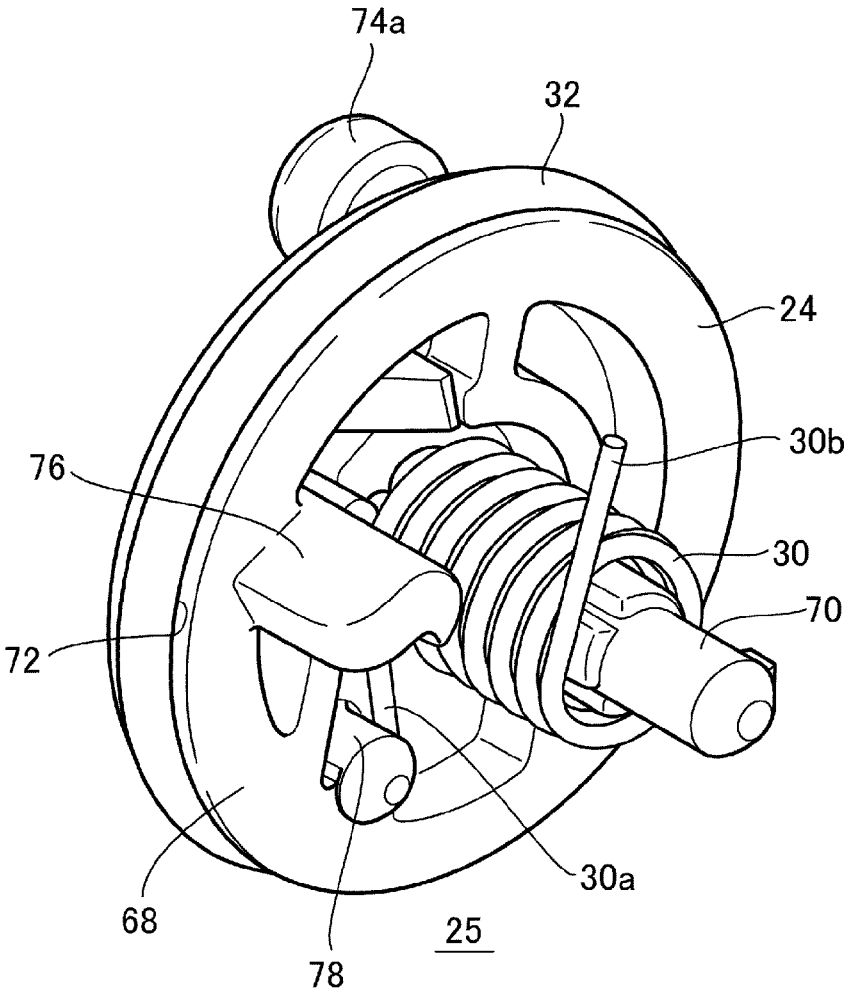
FIG. 7 is a perspective view of a driving member.

FIG. 7 is a perspective view of the driving member 25. The driving member 25 includes the rotor member 24, a spring member 30, and a ring member 32. The coiled spring member 30 is disposed into which the rotating shaft portion 70 is inserted, and the ring member 32 is engaged with to be retained by the retaining groove portion 72 having an annular shape.

A first winding end portion 30*a* of the spring member 30 is arranged to abut on the spring receiving portion 78 of the rotor portion 24 while a second winding end portion 30*b* of the spring member 30 is arranged to abut on the spring receiving portion 62 of the base member 22. The spring member 30 is arranged to urge, when a user performs unlocking manipulation, the rotor portion 24 in a direction to bring the locking members 26, which are brought into an unlocked state, into a locked state.

The ring member 32 defines a rubber O-ring, and is disposed on the outer circumference of the disk portion 68. The ring member 32 contacts the inner wall of the rotor supporting wall 50, whereby the rate of rotation of the driving member 25 is reduced. The driving member 25 is mounted on the base member 22.

Figure 8A:
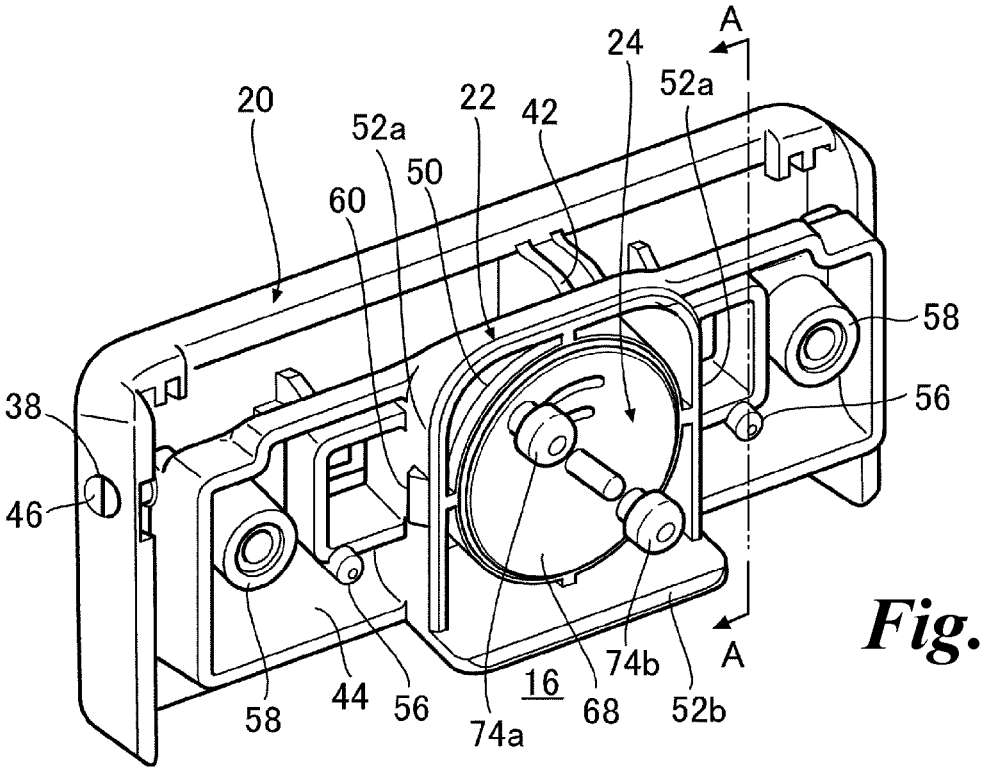
FIGS. 8A and 8B are views for illustrating a sub-assembly unit of the locking device that is yet to be mounted on the opening and closing member.
Figure 8B:
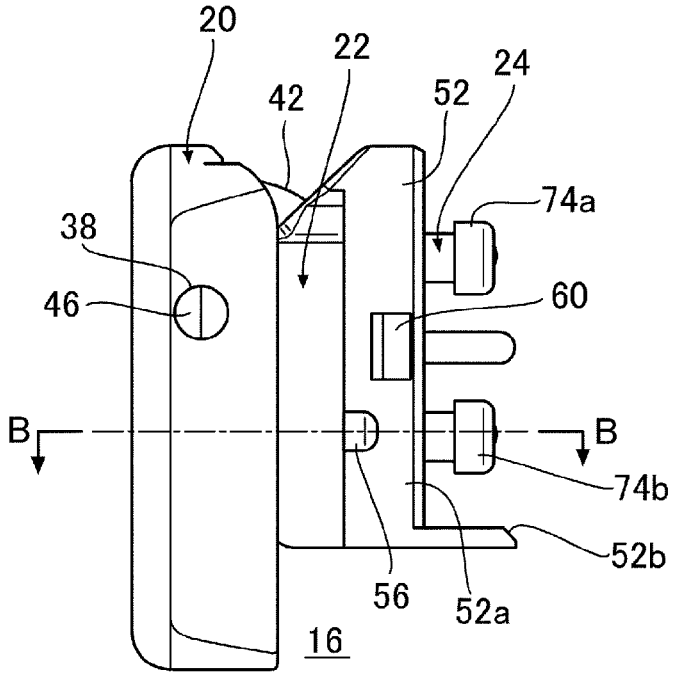

FIGS. 8A and 8B are views for illustrating the sub-assembly unit 16 of the locking device 10 that is yet to be mounted on the opening and closing member 12. FIG. 8A is a perspective view of the sub-assembly unit 16 as viewed from a back side thereof, and FIG. 8B is a side view of the sub-assembly unit 16.

The sub-assembly unit 16 includes the manipulation member 20, the base member 22, and the driving member 25. The manipulation member 20 is connected to the base member 22 by connecting the rotational shaft holes 38 to the rotational movement supporting portions 46. The driving member 25 shown in FIG. 7 is inserted into the rotor supporting wall 50, whereby the base member 22 is connected to the driving member 25.

The rotating shaft portion 70 of the rotor member 24 shown in FIG. 7 is rotatably supported by the driving bearing portion 48 of the base member 22 shown in FIG. 5A. The distal end portion of the rotating shaft portion 70 is engaged with the edge of the driving bearing portion 48 to retain the driving member 25. The integrated sub-assembly unit 16 is mounted on the opening and closing member 12.

Comparing the protrusion height of the second locating portions 56 and the protrusion height of the first locating portion 52 shown in FIG. 8B, the first locating portion 52 protrudes higher than the second locating portions 56.

Figure 9A:
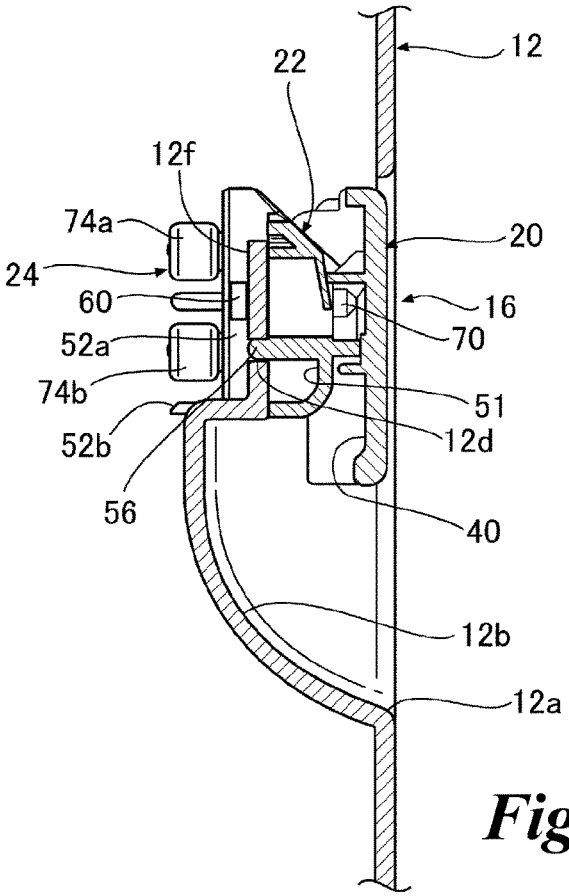
FIGS. 9A and 9B are views for illustrating the locking device that is mounted on the opening and closing member.
Figure 9B:
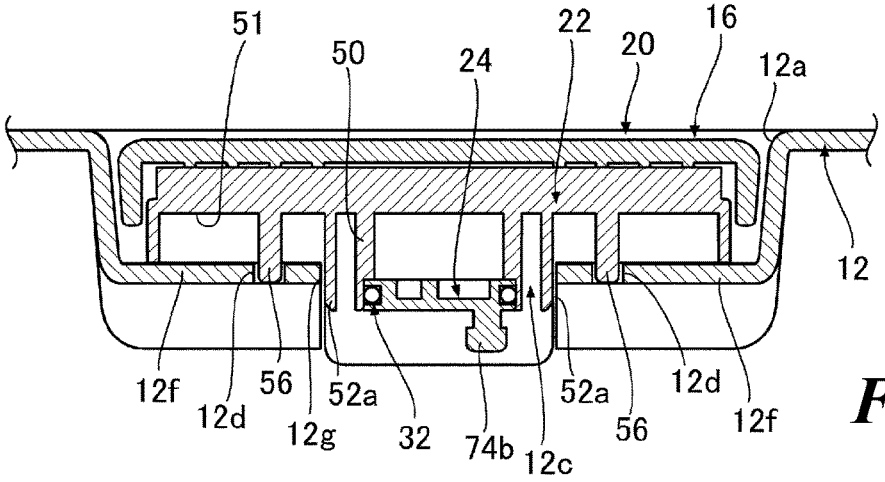

FIGS. 9A and 9B are views for illustrating the locking device 10 that is mounted on the opening and closing member 12. FIG. 9A is a cross-sectional view of the sub-assembly unit 16 taken along the line A-A of FIG. 8A. FIG. 9B is a cross-sectional view of the sub-assembly unit 16 taken along the line B-B of FIG. 8B. FIGS. 9A and 9B both illustrate cross sections passing through the second locating portions 56.

The sub-assembly unit 16 is mounted to be housed in the mounting port 12*a* of the opening and closing member 12. As shown in FIG. 9B, the first locating portion 52 is inserted into the opening portion 12*c* while the second locating portions 56 are inserted into the locating holes 12*d*.

The connecting portions 74 of the rotor member 24 protrude toward the back side more than the opening portion 12*c* to be connected to the locking members 26. As shown in FIG. 9B, the second locating portions 56 are mounted so as not to protrude from the back sides of the mount surfaces 12*f* through the locating holes 12*d* in order not to interfere with the movement of the locking members 26. The second locating portions 56 may protrude from the back sides of the mount surfaces 12*f* as long as they do not interfere with the locking members 26.

The engagement pawl portions 60 are engaged with the mount surfaces 12*f*, and function as temporarily fixing portions for the sub-assembly unit 16 before the sub-assembly unit 16 is fixed with the screw members 28 in being mounted. By temporarily fixing the sub-assembly unit 16 to the mount surfaces 12*f* by the engagement of the engagement pawl portions 60, a user can once release his/her hands from the sub-assembly unit 16 in fixing the sub-assembly unit 16 with the screw members 28, which enables easy screwing work.

As shown in FIG. 9B, the first locating portion 52 protrudes toward the back side of the pedestal surface 51 more than the second locating portions 56. The protrusion height of the first locating portion 52 from the pedestal surface 51 is larget than the protrusion height of the second locating portions 56 from the pedestal surface 51. While the first locating portion 52 protrudes toward the back side more than the mount surfaces 12*f*, the second locating portions 56 do not protrude from the back side of the mount surfaces 12*f*.

Figure 10A:
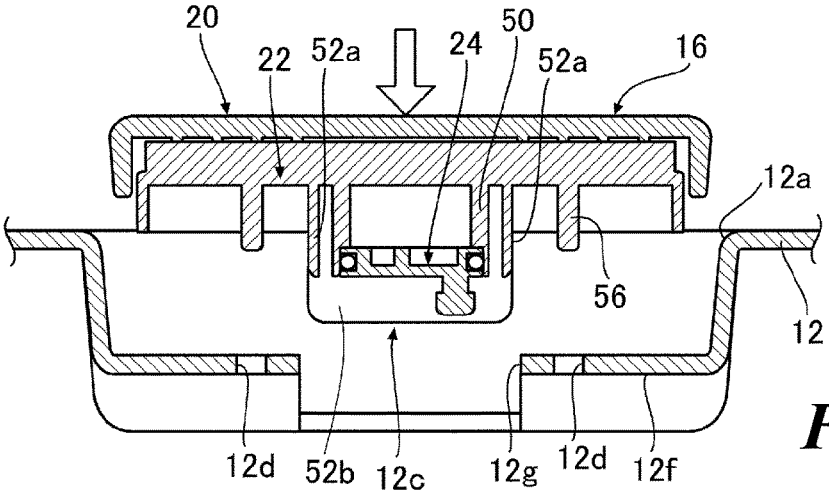
FIGS. 10A to 10C are views for illustrating a method for mounting the sub-assembly unit on the opening and closing member.
Figure 10B:
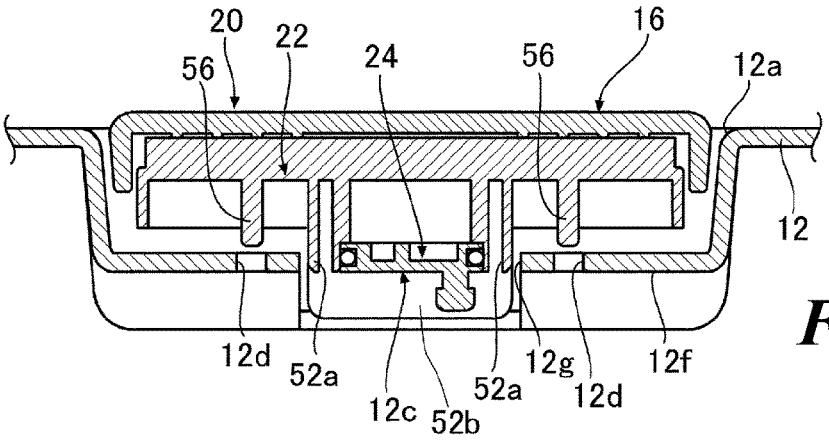
Figure 10C:
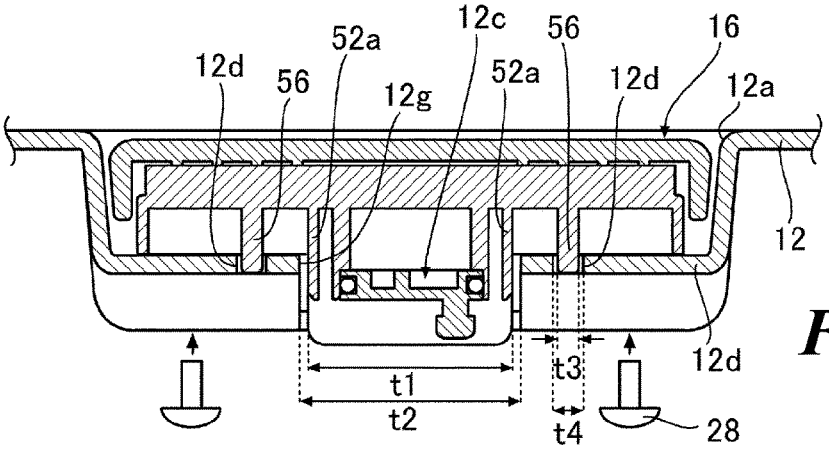

FIGS. 10A to 10C are views for illustrating a method for mounting the sub-assembly unit 16 on the opening and closing member 12. FIGS. 10A, 10B, and 10C illustrate cross sections of the opening and closing member 12 and the sub-assembly unit 16 in mounting steps. The first mounting step is shown in FIG. 10A, the second mounting step is shown in FIG. 10B, and the third mounting step and the fourth mounting step are shown in FIG. 10C. In FIGS. 10A to 10C, the opening portion 12C is illustrated larger in width on purpose than the opening portion 12*c* shown in FIG. 9B in order to easily comprehend the locking device 10 according to the embodiment.

In the first mounting step shown in FIG. 10A, a user brings the sub-assembly unit 16 closer to the mount surfaces 12*f* of the opening and closing member 12 while aiming the first locating portion 52, which is disposed in the center of the base member 22, at the opening portion 12*c* that is larger than the locating holes 12*d*.

In the second mounting step shown in FIG. 10B, the user further brings the sub-assembly unit 16 closer to the mount surfaces 12*f*, inserts the first locating portion 52 into the opening portion 12*c*, and causing the first locating portion 52 to contact or closely face the edge portions 12*g* of the opening portion 12*c*. The step of inserting the first locating portion 52 into the opening portion 12*c* includes a step of first inserting the connecting wall portion 52*b* into the opening portion 12*c* to restrict displacement in the width direction, and a step of inserting the pair of facing wall portions 52*a* into the opening portion 12*c* to restrict rotation of the first locating portion 52.

In this manner, a relative displacement width between the second locating portions 56 and the locating holes 12*d* is restricted. The relative displacement width between the second locating portions 56 and the locating holes 12*d* defines a distance between the second locating portions 56 and the locating holes 12*d* in the two dimension parallel to the mount surfaces 12*f*.

While the second locating portions 56 are not inserted into the locating holes 12*d* in FIG. 10B, the second locating portions 56 are disposed at positions where the relative displacement width with respect to the locating holes 12*d* is very small. As described above, since the first locating portion 52 is inserted into the opening portion 12*c* to contact or closely face the edge portions 12*g* of the opening portion 12*c*, the relative displacement width between the second locating portions 56 and the locating holes 12*d* is made small before the second locating portions 56 are inserted into the locating holes 12*d*, which allows the second locating portions 56 to be easily inserted into the locating holes 12*d*.

In the third mounting step shown in FIG. 10C, the sub-assembly unit 16 is further pushed into the mount surfaces 12*f*, and thus the second locating portions 56 are inserted into the locating holes 12*d*. Since the first locating portion 52 is already inserted into the opening portion 12*c*, the second locating portions 56 and the locating holes 12*d* are in the state of being roughly aligned with each other in the second mounting step. Thus, only slight positional adjustment by the user allows the second locating portions 56 to be easily inserted into locating holes 12*d*. By sequentially inserting the two locating portions that are different in protrusion height into the two opening portions on the mount surfaces 12*f* in this manner, the movement of the sub-assembly unit 16 can be controlled in stages, whereby the sub-assembly unit 16 can be easily mounted. As a result that the user inserts the first locating portion 52 into the opening portion 12*c*, the movement of the second locating portions 56 is restricted, allowing the second locating portions 56 to be guided into the locating holes 12*d*.

After the insertion of the first locating portion 52 into the opening portion 12*c*, the second locating portions 56 are inserted into the locating holes 12*d*, thereby making positioning of the locking device 10. By positioning of the locking device 10, the thread receiving portions 58 are aligned with the screw holes 12*e*.

In the third mounting step, the engagement of the engagement pawl portions 60 allows the sub-assembly unit 16 to be temporarily fixed to the mount surfaces 12*f*. In this manner, the user can once release his/her hands from the sub-assembly unit 16, and then fix the sub-assembly unit 16 with the screw members 28 in the next mounting step.

In the next fourth mounting step, the screw members 28 are inserted into the screw holes 12*e* and the thread receiving portions 58, and thus the sub-assembly unit 16 is fixed to the mount surfaces 12*f* without rattling. Then, the locking members 26 are connected to the rotor member 24, and thus mounting of the locking device 10 is completed.

The first clearance t1 shown in FIG. 10C defines a space between the outer walls of the pair of the facing wall portions 52*a* in the width direction, and the second clearance t2 shown in FIG. 10C defines a space between the pair of edge portions 12*g* of the opening portion 12*c* in the width direction. In addition, the third clearance t3 shown in FIG. 10C defines a diameter of each second locating portion 56, and the fourth clearance t4 shown in FIG. 10C defines the inside diameter of each locating hole 12*d*. The locking device 10 and the opening and closing member 12 are disposed so as to satisfy following Expression 1.

$$(t2-t1)>(t4-t3) \qquad \text{Expression 1}$$

This expression means that the clearance between the first locating portion 52 and the opening portion 12*c* is larger than the clearance between each second locating portion 56 and each locating hole 12*d* at least in the width direction. In the mounting step of the sub-assembly unit 16, the work of inserting the first locating portion 52 into the opening portion 12*c* where the clearance is relatively larger is first performed. The second locating portions 56 and the locating holes 12*d* where the clearances are relatively smaller are thus roughly aligned with each other, and then the work of inserting the second locating portions 56 into the locating holes 12*d* is performed. In this manner, the second locating portions 56 can be easily inserted into the locating holes 12*d*.

The insertion of the first locating portion 52 into the opening portion 12*c* (the first opening portion) defines mounting work in the first stage, and the insertion of the second locating portions 56 into the locating holes 12*d* (the second opening portion) defines mounting work in the second stage. The work of inserting the first locating portion 52 into the opening portion 12*c* that is a large hole is easier than the work of inserting the small locating pins into the small locating holes 12*d*. Thus, the mounting work in the second stage is also made easy by the mounting work in the first stage in which the insertion is relatively easier, whereby the locking device 10 can be easily mounted. Restricting the relative displacement width between the second locating portions 56 and the locating holes 12*d* by the mounting work in the first stage makes the insertion of the second locating portions 56 into the locating holes 12*d* in the mounting work in the second stage easier than the mounting work in the first stage.

By defining the second locating portions 56 as a pair of locating pins, the rotation of the base member 22 can be restricted to improve the positioning accuracy.

Since the first locating portion 52 includes the pair of facing wall portions 52*a*, the rotation of the sub-assembly unit 16 can be restricted when the facing wall portions 52*a* are inserted into the opening portion 12*c* while the displacement width of the facing wall portions 52*a* in the width direction is restricted. Since the first locating portion 52 includes the connecting wall portion 52*b* that connects the pair of facing wall portions 52*a*, the first locating portion 52 surrounds the rotor member 24 to prevent the rotor member 24 from contacting the edge portions 12*g* of the opening portion 12*c* or the like during the mounting work, whereby the rotor member 24 can be protected.

The engagement pawl portions 60 are engaged with the opening portion 12*c* when the insertion of the second locating portions 56 into the locating holes 12*d* is completed. In other words, the engagement pawl portions 60 are not engaged with the opening portion 12*c* before the insertion of the second locating portions 56 into the locating holes 12*d* is completed. Further, the engagement pawl portions 60 are not engaged with the opening portion 12*c* during the time when the second locating portions 56 are being inserted into the locating holes 12*d*. This configuration can prevent only one of the pair of engagement pawl portions 60 from being first engaged with the opening portion 12*c* to interfere with the insertion of the second locating portions 56 into the locating holes 12*d*.

Figure 11A:
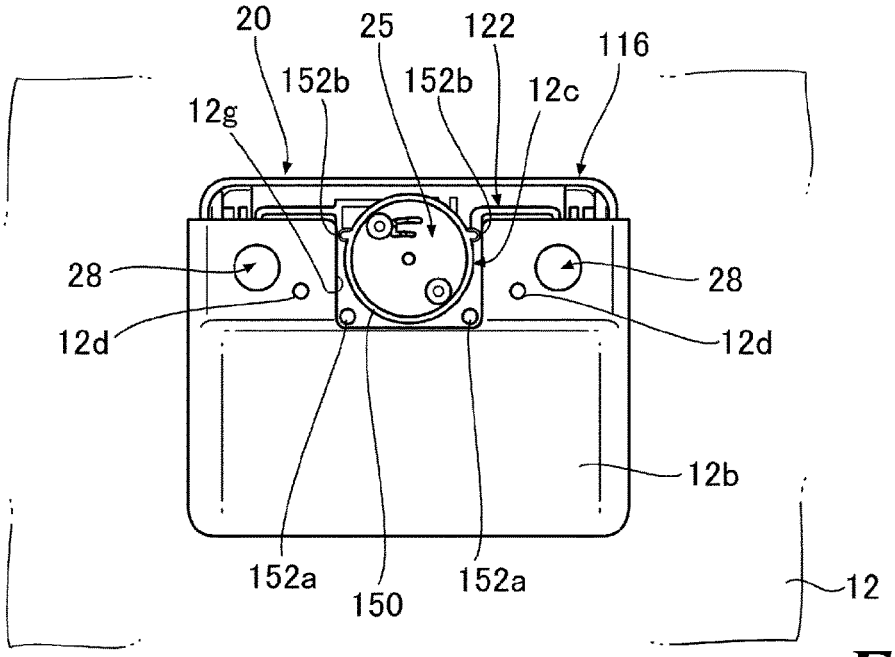
FIGS. 11A and 11B are views for illustrating a locking device according to the first modification.
Figure 11B:
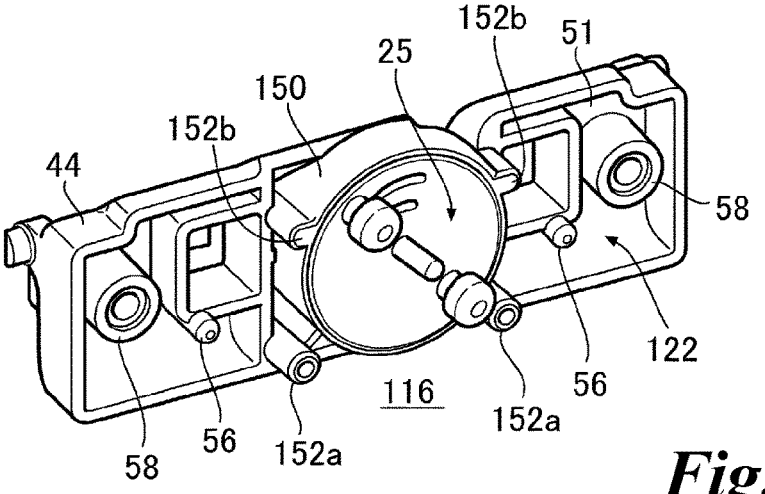

FIGS. 11A and 11B are views for illustrating a locking device according to the first modification. FIG. 11A is a back side view of a sub-assembly unit 116 according to the first modification that is mounted on the opening and closing member 12, and FIG. 11B is a perspective view of the sub-assembly unit 116 according to the first modification. FIG. 11B shows the sub-assembly unit 116 where the manipulation member 20 is not illustrated.

A base member 122 according to the first modification shown in FIG. 11B is different in including rod-shaped first locating portions instead of the wall-shaped first locating portion 52 from the base member 22 shown in FIG. 8A.

The base member 122 at least includes a rotor supporting wall 150 arranged to house the driving member 25, and the first locating portions disposed around the driving member 25. The first locating portions include rod bodies 152*a* having a rod shape and disposed slightly outside of the rotor supporting wall 150 in the width direction, and a pair of protruding portions 152 protruding outward in the radial direction from the outer circumference of the rotor supporting wall 150.

The pair of rod bodies 152*a* and the pair of protruding portions 152*b* are arranged around the rotor supporting wall 150 so as to be disposed at the vertices of a oblong shape or a square shape. The first locating portions protrude toward the back side of the pedestal surface 51 more than the second locating portions 56.

As shown in FIG. 11A, the first locating portions contact or closely face the opening portion 12*c*. By disposing the first locating portions, which are shaped into four protrusions, at the vertices of the rectangle, the rotation of the sub-assembly unit 116 can be restricted when the sub-assembly unit 116 is mounted. When the rocking device 10 is mounted on the opening and closing member 12, the first locating portions according to the first modification contact or closely face the edge portions 12g of the opening portion 12*c* before the second locating portions 56 are inserted into the locating holes 12*d*, which allows the second locating portions 56 to be easily inserted. With this configuration, the locking device 10 can be easily mounted.

Figure 12A:
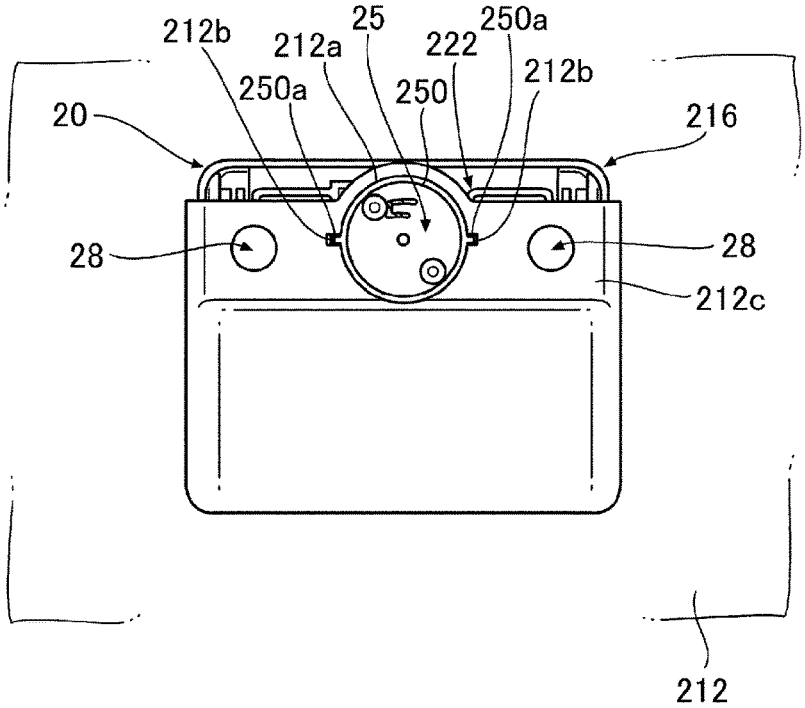
FIGS. 12A and 12B are views for illustrating a locking device according to the second modification.
Figure 12B:
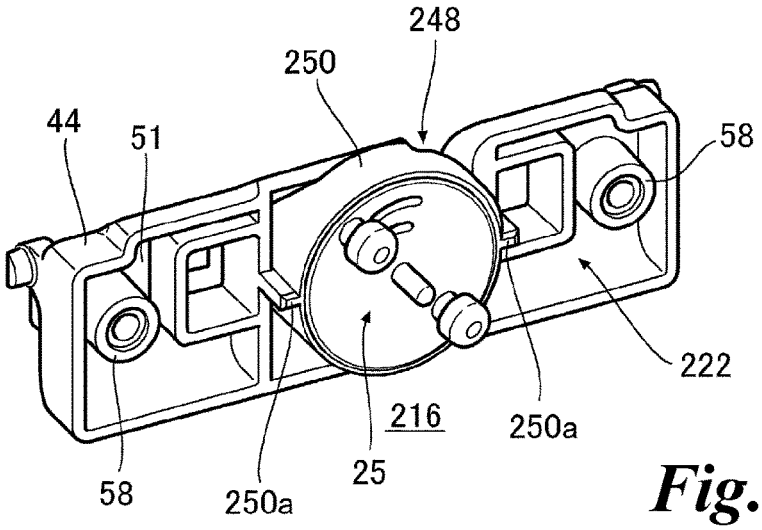

FIGS. 12A and 12B are views for illustrating a locking device according to the second modification. FIG. 12A is a back side view of a sub-assembly unit 216 according to the second modification that is mounted on an opening and closing member 212, and FIG. 12B is a perspective view of the sub-assembly unit 216 according to the second modification. FIG. 12B shows the sub-assembly unit 216 where the manipulation member 20 is not illustrated.

A base member 222 according to the second modification shown in FIG. 12B is different in not including the second locating portions 56 and the first locating portion 52 from the base member 22 shown in FIG. 8A. In addition, the opening and closing member 212 according to the second modification shown in FIG. 12A is different in not including the locating holes 12*d* and in including an annular-shaped opening portion 212a from the opening and closing member 12 shown in FIG. 3A.

As shown in FIG. 12B, a locating portion 250 is erected from the pedestal surface 51, has a circular cylindrical shape, and houses the driving member 25. The locating portion 250 includes a pair of protruding portions 250*a* protruding outward in the radial direction. The locating portion 250 functions also as a supporting wall for the rotor member 24.

As shown in FIG. 12A, the mounting port of the opening and closing member 212 includes an annular-shaped opening portion 212*a* disposed on a mount surface 212*c*, and a pair of cutout portions 212*b* that are made by cutting out portions of the inner circumference of the opening portion 212*a* outward in the radial direction. The inside diameter of the opening portion 212*a* is set to be almost same as the outside diameter of the locating portion 250 while the inside diameter of the opening portion 212*a* is larger than the outside diameter of the locating portion 250.

The locating portion 250 is inserted into the opening portion 212*a*, and thus the sub-assembly unit 216 is fixed to the mount surface 212*c* with the screw members 28. When the sub-assembly unit 216 is mounted on the opening and closing member 212, the locating portion 250 contact or closely face the opening portion 212*a*, thereby making positioning of the sub-assembly unit 216.

The locating portion 250 is disposed around the rotor member 24 to prevent the rotor member 24 from contacting the edge portion of the opening portion 212*a* during the mounting work or after the completion of mounting. The pair of protruding portions 250*a* get in the pair of cutout portions 212*b* of the opening portion 212*a*, and can restrict the rotation of the sub-assembly unit 216 before screwed. In the second modification, the locating portion 250 can protect the rotor member 24 and can make positioning of the rotor member 24.

Figure 13A:
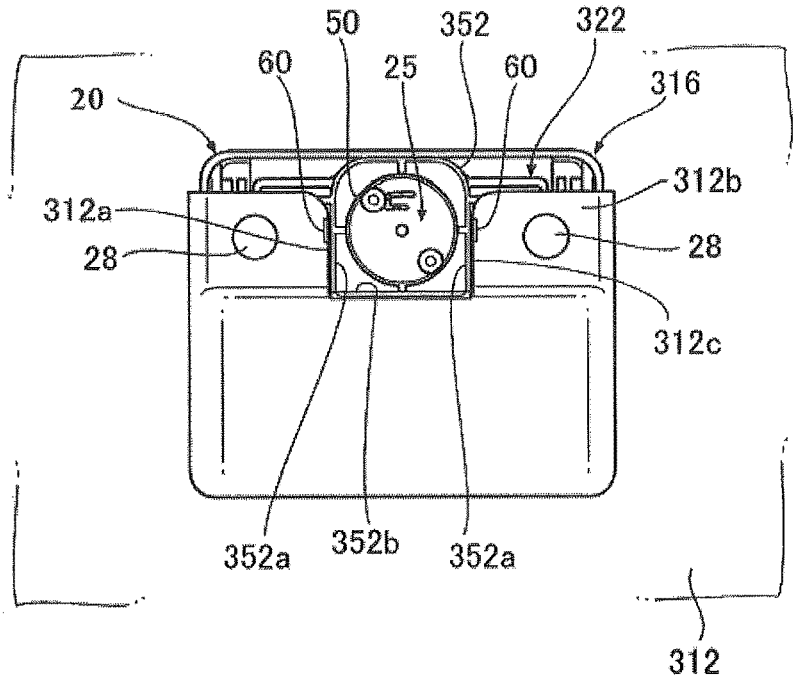
FIGS. 13A and 13B are views for illustrating a locking device according to the third modification.
Figure 13B:
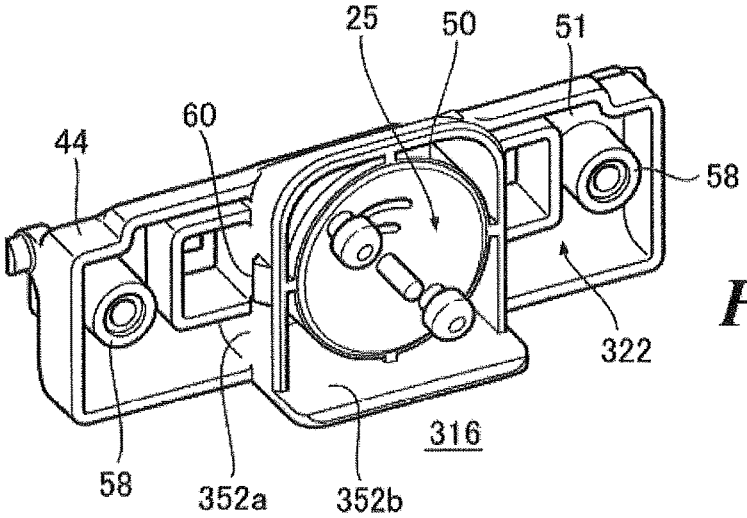

FIGS. 13A and 13B are views for illustrating a locking device according to the third modification. FIG. 13A is a back side view of a sub-assembly unit 316 according to the third modification that is mounted on the opening and closing member 12, and FIG. 13B is a perspective view of the sub-assembly unit 316 according to the third modification. FIG. 13B shows the sub-assembly unit 316 where the manipulation member 20 is not illustrated.

A base member 322 according to the third modification shown in FIG. 13B is different in not including the second locating portions 56 from the base member 22 shown in FIG. 8A. In addition, the opening and closing member 312 according to the third modification shown in FIG. 13A is different in not including the locating holes 12*d* from the opening and closing member 12 shown in FIG. 3A.

As shown in FIG. 13B, a locating portion 352 is erected from the pedestal surface 51, and disposed around the rotor member 24. The rotor supporting wall 50 is disposed inside of the locating portion 352. The locating portion 352 includes a pair of facing wall portions 352*a* that face each other in the width direction, and a connecting wall portion 352*b* that connects the facing wall portions 352*a*.

The locating portion 352 is inserted into an opening portion 312*a*, and thus the sub-assembly unit 316 is fixed to a mount surface 312*c* with the screw members 28. When the sub-assembly unit 316 is mounted on the opening and closing member 312, the locating portion 352 contacts or closely faces an opening portion 312*a*, thereby making positioning of the sub-assembly unit 316.

In the third modification, a clearance t5 between the edge portions of the opening portion 312*a* in the width direction and a clearance t6 between the outer walls of the pair of facing wall portions 352*a* in the width direction are very small. To be specific, the clearance of (t2–t1) shown in FIG. 10C is smaller than the clearance of (t5–t6). In the third modification, the locating portion 352 can make positioning of the locking device.

The present invention is not limited to the embodiments described above, and it is also possible to add modifications such as various kinds of design changes to the embodiments based on the knowledge of those skilled in the art. Embodiments to which such modifications are added can also be included within the scope of the present invention.

In the embodiment, the rotor member 24 is used as a driving member to drive the locking members 26 by receiving the manipulating force of the manipulation member 20. However, the present invention is not limited thereto. For example, a gear mechanism arranged to rotationally move in accordance with the manipulation of the manipulation member 20 may be used instead of the rotor member 24. The gear mechanism is disposed between the annular-shaped first locating portions 52, and the connecting portion with the locking members 26 protrudes inward more than the opening portion 12*c*.

In the embodiment, the pair of locating pins are used as the second locating portions 56. However, the present invention is not limited thereto. One locating pin may be used, or three or more locating pins may be used. Also in an embodiment where three or more locating pins are used, the first locating portion 52 is disposed between the second locating portions 56.

In the embodiment, the engagement pawl portions 60 are provided to the facing wall portions 52*a*. However, the present invention is not limited thereto. The engagement pawl portions 60 may be engaged with the edges of the mount surfaces 12*f*, and may be disposed at different positions of the base member 22.

DESCRIPTION OF REFERENCE NUMERALS AND SIGNS

10 Locking device
12 Opening and closing member
12*a* Mounting port
12*b* Depressed portion
12*c* Opening portion
12*d* Locating hole
12*e* Screw hole
12*f* Mount surface
12*g* Edge portion
14 Fixing member
16 Sub-assembly unit
20 Manipulation member
22 Base member
24 Rotor member
25 Driving member
26*a* First locking member
26*b* Second locking member
28 Screw member
30 Spring member
32 Ring member
38 Rotating shaft hole
40 Manipulation surface
42 Transmission portion
44 Main body portion
46 Rotational movement supporting portion
48 Driving bearing portion
50 Rotor supporting wall
51 pedestal surface
52 First locating portion
52*a* Facing wall portions
52*b* Connecting wall portion
54 Communicating portion
56 Second locating portion
58 Thread receiving portion
60 Engagement pawl portion
62 Spring receiving portion
64 Rotation regulating portion
68 Disk portion
70 Rotating shaft portion
72 Retaining groove portion
74*a* First connecting portion
74*b* Second connecting portion
76 Abutting portion
78 Spring receiving portion
250 Locating portion

INDUSTRIAL APPLICABILITY

The present invention relates to a locking device to be mounted on an opening and closing member, and a mounting method thereof.

The invention claimed is:

1. A method for mounting a locking device with respect to an opening and closing member including a first opening portion and second opening portions, the locking device including a main body portion, a first locating portion arranged on the main body portion, second locating portions arranged at sides of the first locating portion, and an engagement pawl portion, the method including:

inserting the first locating portion into the first opening portion to restrict a relative displacement between the second locating portions and the second opening portions;

after the first locating portion has been inserted into the first opening portion, inserting the second locating portions into the corresponding second opening portions;

fixing the engagement pawl portion to a mounting surface of the opening and closing member to temporarily position the locking device into the opening and closing member; and after the locking device is temporarily positioned, inserting fasteners through the locking device and the opening and closing member to fixedly secure the locking device with respect to the opening and closing member.

* * * * *